United States Patent [19]

Cook

[11] 4,257,355

[45] Mar. 24, 1981

[54] COLD WATER INLET TUBE

[75] Inventor: Robert E. Cook, Kankakee, Ill.

[73] Assignee: A. O. Smith Corporation, Milwaukee, Wis.

[21] Appl. No.: 67,416

[22] Filed: Aug. 17, 1979

[51] Int. Cl.[3] ..... F22B 5/00

[52] U.S. Cl. ..... 122/17; 122/390; 126/361; 126/362

[58] Field of Search ..... 122/17, 390; 126/361, 126/362, 380; 219/310

[56] References Cited

U.S. PATENT DOCUMENTS

| | | | |
|---|---|---|---|
| 1,163,451 | 12/1915 | Polmann | 126/362 |
| 1,790,357 | 1/1931 | Stack | 126/361 |
| 2,038,476 | 4/1936 | Clark et al. | 126/362 X |
| 3,465,123 | 9/1969 | Harris | 126/361 X |
| 3,688,839 | 9/1972 | Kirschner | 126/362 X |
| 3,776,456 | 12/1973 | Eising | 126/362 X |

*Primary Examiner*—Edward G. Favors

*Attorney, Agent, or Firm*—Andrus, Sceales, Starke & Sawall

[57] ABSTRACT

A cold water inlet tube located in a horizontal position adjacent the bottom of a commercial water heater. Intermittent discharge openings or nozzles are provided in the bottom of the tube and directed at an angle to discharge jets of incoming cold water to the bottom of the water heater in which the tube is assembled to agitate any sediment tending to be deposited on the bottom head of the heater. Similarly, a single generally centrally located opening or nozzle is provided in the top or upper portion of the tube to discharge a jet of cold water upwardly towards the hot water in the upper portion of the water heater to reduce stacking of the water stored in the water heater.

4 Claims, 4 Drawing Figures

COLD WATER INLET TUBE

BACKGROUND OF THE INVENTION

Multi-flue type commercial water heaters have historically provided two serious problems. These heaters are prone to temperature stacking of the stored water with the water in the top of the heater tank being overheated. And because of the firing of the bottom head of the tank from outside, these commercial water heaters are highly subject to early failure because of sediment deposit on the bottom head. The invention overcomes these problems by a specially constructed cold water inlet tube which improves draw and reduces both stacking of the stored water and sediment deposits.

SUMMARY OF THE INVENTION

The invention is particularly directed to a large water storage heater normally for commercial usage which is heated by a gas or other burners located below the bottom head of the heater. Combustion gases are discharged from the burner through a plurality of flues which extend through the inside of the heater from the lower head and through the upper head.

Under the construction of the invention a removable cold water inlet tube is located adjacent the bottom of the heater in a horizontal position. The diameter of the tube is of a size so that it can be slide through an opening in the shell of the water heater and has a fitting at the outer end which is threaded into a nipple secured to the shell of the water heater around the opening. Cold water inlet piping is threaded to the outer end of the fitting and extends upwardly outside the water heater to a source of cold water.

The cold water inlet tube is closed at the inner end and the bottom of the tube facing the lower head is provided with a plurality of intermittently spaced and angularly located openings or nozzles which discharge the incoming cold water in the form of jets toward the lower head of the heater to agitate any sediment which may tend to be deposited on the lower head.

In addition the top or upper portion of the tube is provided with a generally centrally located opening or nozzle which discharges a jet of cold water upwardly toward the upper head of the water heater and thereby reduces the tendency of the water to stratify and hereby prevents the hottest water from gradually accumulating in the top of the water heater or igniter.

The water heater is completed by the usual thermostat which actuates a valve to supply gas to the gas burner to be ignited by the usual pilot burner.

DETAILED DESCRIPTION OF THE INVENTION

Figure 1:
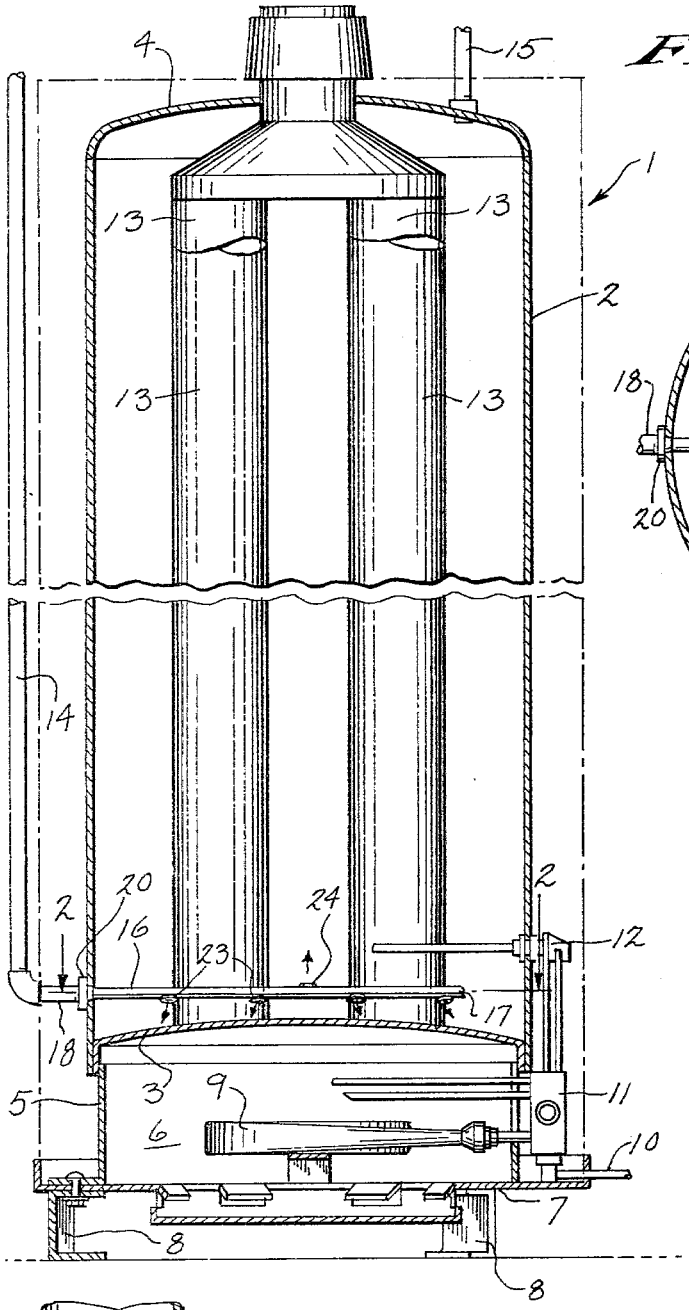
FIG. 1 is a vertical section of a gas fired multi-flue commercial water heater embodying the invention.
Figure 2:
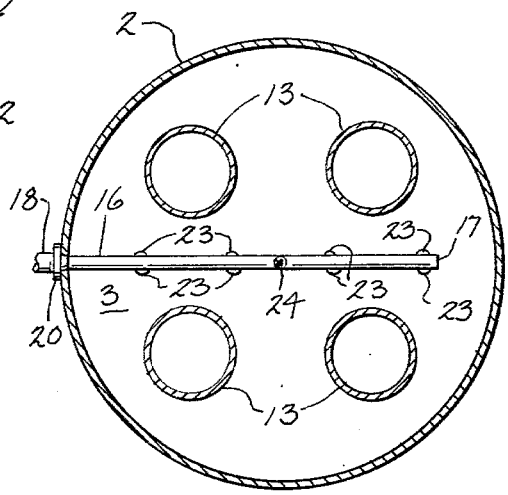
FIG. 2 is a section taken on line 2—2 of FIG. 1.
Figure 4:
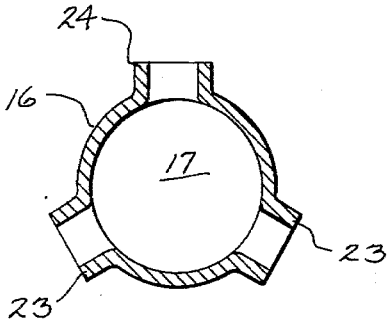
FIG. 4 is a cross section of the inlet tube taken on line 4—4 of FIG. 3.
Figure 3:
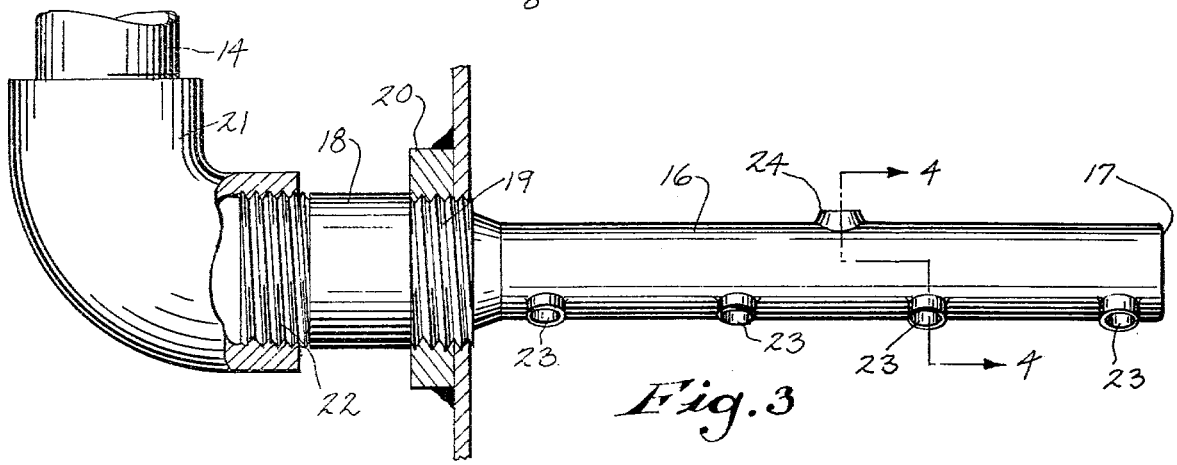
FIG. 3 is an enlarged vertical section of the water heater of FIG. 1 with parts removed to better illustrate the inlet tube of the invention.

Referring to the drawings which illustrate the preferred embodiment of the invention, there is shown a water heater including a tank 1 formed of a cylindrical shell 2 which is enclosed by a lower head 3 and an upper head 4. The outer housing and insulation for tank 1 is illustrated in FIG. 1 in phantom.

A generally cylindrical skirt 5 is secured at the upper end to lower head 3 and extends downwardly to define a burner compartment 6. The lower end of burner compartment 6 is closed by a plate 7 and a plurality of legs 8 are secured to plate 7 to support the water heater on a surface as illustrated in the drawings.

Water is heated within tank 1 by a gas burner 9 disposed in burner compartment 6 and gas is supplied to burner 9 through gas line 10 with the flow of gas within line 10 being controlled by a thermostatically operated gas valve 11. The operation of the burner 9 is controlled by a thermostat 12 which is disposed within the water heater through an opening in the wall of shell 2 and is responsive to the temperature of the water in the lower part of tank 1. Thermostat 12 is operably connected to the solenoid operated gas valve 11 to open the valve to admit gas to burner 9 when the temperature of the water within tank 1 falls below the setting of thermostat 12.

To conduct the gases of combustion from burner compartment 6 a plurality of vertical flues 13, four such flues being illustrated, are disposed inside of tank 1 and extend through suitable openings in heads 3 and 4.

Cold water is introduced into tank 1 through a conduit 14 which extends to the lower portion of tank 1 and hot water is withdrawn from tank 1 through a conduit 15 which extends through an opening in the upper head 4.

In a water heater, and particularly a gas fired heater having a plurality of flues 13, the water in the upper portion of tank 1 tends to be heated above the temperature setting of the thermostat 12, such as 180° F. due to small intermittent draws of water from the tank, which results when burner 9 is placed in operation. This phenomena is known as stratification or stacking and it endangers the life of the heater and wastes heat. Also, code requirements have been established under which the hot water drawn from the water heater may not exceed a defined temperature.

Also in a water heater, particularly of the gas fired type, sedimentation tends to build up on the inner surface of the lower head 3 of tank 1. This reduces the performance of the water heater and may cause early failure of the lower head under the firing bottom head principle.

To overcome these problems the water heater of the invention is provided with a horizontally extending cold water inlet tube 16 in the lower portion of tank 1. The inner end 17 of tube 16 is closed and the outer end may be of various constructions but is shown as connected inside the cold water inlet fitting 18 which has threads 19 for threading into the nipple 20 which is secured to the shell 2 of tank 1 to support the inlet tube 16 in a horizontal position inside the lower portion of tank 1. The fitting 21 of cold water conduit 14 is readily coupled to cold water inlet tube 16 by means of the threads 22 at the outer end of inlet tube fitting 18 to join the conduit 14 and cold water inlet tube 16 together.

Cold water inlet tube 16 has a diameter less than that of fitting 18 and nipple 20 to pass through the opening in the wall of shell 1. By this construction it is a simple matter to disconnect the cold water conduit 14 from fitting 21 and then unthread inlet tube fitting 18 from nipple 20 and pull the cold water inlet tube 16 out of tank 1 so that it can be cleaned and then easily replaced.

Inlet tube 16, as shown in the drawings, has a plurality of intermittent openings or nozzles 23 which provide a jet-like discharge of incoming cold water downwardly of tube 16. Nozzles 23 are located on an angle to discharge cold water over a generally large area and provide a jet action to the incoming discharged cold water directed toward bottom head 3.

A single opening or nozzle 24 is provided generally centrally of the top or upper portion of the body of inlet tube 16 to discharge a jet of cold water upwardly toward the hot water stored in the upper portion of the heater.

The angular nozzles or jets 22 in the bottom of tube 16 agitate any sediment tending to form in the bottom of tank 1 and thereby prevent a build up or deposit of the sediment on lower head 3.

By employing only one jet nozzle 24 in the upper side of tube 16, the pressure of the upwardly discharged cold water is increased. Nozzle 24 which discharges the cold water upwardly in tank 1 thus reduces stacking and the build up of high temperature water in the upper portion of the water heater.

The construction of the invention provides for an improved draw, reduces stacking and effects sediment agitation to reduce sediment deposits on the lower head to add to the life of the water heater.

Various modes of carrying out the invention are contemplated as being within the scope of the following claims particularly pointing out and distinctly claiming the subject matter which is regarded as the invention.

I claim:

1. For use with a water heater having a cylindrical tank provided by a cylindrical shell closed by upper and lower heads and a cold water conduit and a hot water conduit and means to heat the water stored therein, the improvement comprising a cold water inlet tube adapted to extend through an opening in the tank shell to the inside of the tank and be lodged in a horizontal plane adjacent the lower head, means at the outer end of the tube adapted to connect the latter to the cold water conduit, the inner end of the cold water inlet tube being closed and the tube being of a size to readily slip through the opening in the shell for insertion and removal for cleaning, a single generally centrally located jet-like opening in the upper surface of the tube formed somewhat in the shape of a nozzle for discharge of incoming cold water upwardly toward the upper head of the tank to overcome the problem of stacking, and a plurality of corresponding intermittent openings adjacent the bottom of the tube for discharge of cold water toward the lower head to agitate sediment in the bottom of the tank and prevent build up of sediment deposits on the inner surface of the lower head of the tank.

2. The cold water inlet tube of claim 1, and the openings in the lower portion of the cold water inlet tube being directed at an angle with respect to the bottom of the tube to project the jet-like discharges of cold water over a larger area toward the lower head of the tank.

3. The cold water inlet tube of claim 1, and the means at the outer end of the cold water inlet tube to connect the tube to the cold water conduit being a fitting of a larger size than the cold water inlet tube and having threads located on the outside of each end of the fitting, an internally threaded nipple provided around the opening in the shell through which the cold water inlet tube is inserted and withdrawn, and the inner threads of the fitting adapted to be threaded home inside the nipple from outside the tank, and outer threads on the fitting adapted to connect the cold water conduit thereto and thereby to the cold water inlet tube.

4. The cold water inlet tube of claim 1 and the water heater to which the tube is applied being a water heater with a plurality of internal flues, and a burner disposed below the lower head to provide the heat for the water heater, and the combustion gases being discharged upwardly through the plurality of flues.

* * * * *